United States Patent [19]

Odenwälder et al.

[11] 4,184,875

[45] Jan. 22, 1980

[54] PHOTOGRAPHIC REVERSAL PROCESS

[75] Inventors: Heinrich Odenwälder, Cologne; Ubbo Wernicke, Odenthal, both of Fed. Rep. of Germany

[73] Assignee: AGFA-Gevaert, A.G., Fed. Rep. of Germany

[21] Appl. No.: 899,993

[22] Filed: Apr. 25, 1978

[30] Foreign Application Priority Data

Apr. 30, 1977 [DE] Fed. Rep. of Germany ..... 2719371

[51] Int. Cl.[2] ..... G03C 5/50; G03C 7/16

[52] U.S. Cl. ..... 430/407; 430/379; 430/410; 430/449

[58] Field of Search ..... 96/59, 22

[56] References Cited

U.S. PATENT DOCUMENTS

| | | | |
|---|---|---|---|
| 2,495,000 | 1/1950 | Hanford | 96/22 |
| 2,498,418 | 2/1950 | Hanford | 96/22 |
| 3,186,840 | 6/1965 | Puschel et al. | 96/22 |
| 3,565,620 | 2/1971 | Willems et al. | 96/59 |
| 3,576,633 | 4/1971 | Henn et al. | 96/59 |
| 3,597,199 | 8/1971 | Glockner et al. | 96/59 |
| 3,640,717 | 2/1972 | Gallet et al. | 96/59 |
| 3,809,563 | 5/1974 | Nimura et al. | 96/22 |

FOREIGN PATENT DOCUMENTS 2308530 8/1974 Fed. Rep. of Germany ..... 96/59

*Primary Examiner*—Mary F. Kelley

*Attorney, Agent, or Firm*—Connolly & Hutz

[57] ABSTRACT

Positive images including color images are obtained by a photographic reversal process by imagewise exposure of a material which comprises at least one light-sensitive silver halide emulsion layer, black and white development, fogging and color development characterized in that the fogging is carried out in the presence of a compound of the formula

I

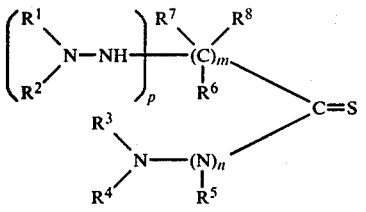

wherein the symbols are defined as hereinafter.

4 Claims, No Drawings

PHOTOGRAPHIC REVERSAL PROCESS

This invention relates to an improved reversal process and improved baths for the production of positive photographic images.

In the usual photographic reversal processes for producing positive black-and-white or colour photographs, the photographic material which has been exposed imagewise is first developed with a first developer. It is then uniformly exposed and the exposed material is subjected to a second development with a black-and-white developer or a colour developer. The process is completed by fixing in the case of black-and-white processes and bleaching and fixing or bleach-fixing in the case of colour materials.

These reversal processes could be made much simpler and more reliable if the second exposure could be replaced by some other suitable treatment of the photographic material. A second exposure is particularly difficult to carry out on roll films and miniature films in spirals and on sheet films in sheet film holders for multiple use.

It is known that the uniform exposure can be replaced by using chemical fogging agents which are added at the latest to the second development. Compounds which have been described for this purpose include, for example, boranocarbonates, borohydrides, alkylaminoboranes, tin-(II) compounds and thioureas. Fogging agents have been described in, for example, German Offenlegungsschriften Nos. 1,814,834 and 1,622,258.

One disadvantage of some of these compounds is that they are unstable in solution so that their concentration in the solution changes. This has a particularly pronounced effect in the known fogging baths because the correct degree of fogging produced by these baths depends within narrow limits on the correct concentration of active compounds. If, for example, too high a concentration of fogging agent were provided in order to compensate for the loss of fogging agent in use, the fogging agent would not only give rise to the desired formation of nuclei but would reduce additional silver halide which would then not be available for the formation of dye in the colour developer. The choice of strength of reducing agent is also limited because, if a powerful reducing substance is used and attempts are made to attenuate its effect by employing it at a lower concentration, it will not act on different layers to the same extent. In other words, the emulsions used in the various partial layers of photographic material often differ from each other in the extent to which they respond to fogging agent. In some cases, one particular emulsion layer within a photographic material composed of several emulsion layers may require a concentration of fogging agent which is too low for optimum fogging of another emulsion layer in the same photographic material. Many fogging agents require a more strongly alkaline medium for optimum fogging than is customarily used in photographic work.

Another group of known fogging agents causes instability of the colour developer if carried over into the colour developer bath and is unsatisfactory for this reason.

It is therefore an object of this invention to find chemical fogging agents for photographic reversal processes, which reduce or substantially obviate the disadvantages of the known chemical fogging agents and are simple to handle and effective even at low concentrations.

It has now been found that these problems can be solved be causing fogging agents represented by the following general formula I to act even at very low concentrations on the photographic material which is required to be fogged:

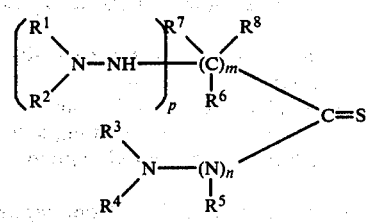

I

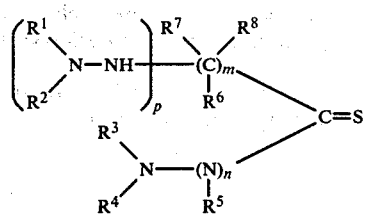

I in which $R^1$ and $R^3$ represent hydrogen, a saturated or olefinically unsaturated aliphatic group, an aryl group, a heterocyclic group or an acyl group;

$R^2$ and $R^4$ represent hydrogen, a saturated or olefinically unsaturated aliphatic group, an aryl group or a heterocyclic group;

$R^5$ represents hydrogen;

$R^6$, $R^7$, $R^8$ represents hydrogen, a saturated or olefinically unsaturated aliphatic group or an aryl group;

n=0 or 1;

m,p=0 or 1 but m and p must never have the same value; and/or $R^1$ and $R^2$ together and/or $R^4$ and $R^3$ together represent an alkylidene group, preferably a methylidene group substituted by hydrogen, alkyl, aryl, a heterocyclic group or acyl, and two such substituents together with the carbon atom of the methylidene group may complete a carbocyclic or heterocyclic ring, for example a cyclopentylidene, indanylidene, cyclohexylidene or piperidinylidene ring. Examples of substituted methylidene groups which are not closed to form a ring are: ethylidene, benzylidene and furfurylidene;

and/or $R^6$ and $R^7$ and $R^8$ together with the carbon atom to which they are joined, represent a carbocyclic ring, in particular a phenyl group and/or $R^2$ together with $R^4$ or $R^5$ represent the group required for completing a 5- or 6-membered heterocyclic ring, in particular a 1,2,3,4-tetrazolidine-5-thione ring, a 1,2,4-triazolidin-5-thione ring, a hexahydro-1,2,4,5-tetrazine-3-thione ring, a hexahydro-1,2,4-triazine-3-thione ring or a 2,3,4,5-tetrahydro-1,2,4-triazine-3-thione ring; this completing group is generally a methylene group which may itself be monosubstituted or disubstituted, e.g. with alkyl, cycloalkyl, aralkyl or aryl; two such substituents, e.g. two alkyl groups, may form a ring together with the carbon atom of the methylene group, in particular a carbocyclic ring, for example a cyclopentane, cyclohexane, 3,3,5-trimethylcyclohexane, cyclododecane or indane ring or a heterocyclic ring such as a piperidine ring.

Examples of saturated aliphatic groups include alkyl groups which may be straight chain, branched chain or cyclic and contain up to 18 carbon atoms and may be further substituted, for example with carboxyl, carbamoyl or nitrile.

The allyl group is an example of an olefinically unsaturated aliphatic group.

A particularly suitable example of an aryl group is phenyl, which may be substituted, for example by halogen, hydroxyl, carboxyl, sulphamoyl, amino and/or alkyl.

The acyl groups are those derived from aliphatic or aromatic carboxylic or sulphonic acids, including carbonic acid monoesters, carbamic acids and sulphamic acids. Examples of such acyl groups include formyl, acetyl, benzoyl, phenylcarbamoyl and ethoxycarbonyl groups.

Preferred compounds of formula I are those represented by the following formulae II to IV:

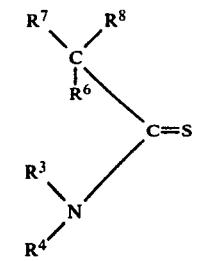

II

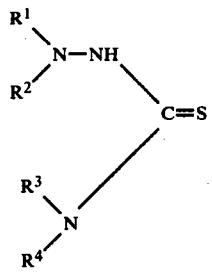

III

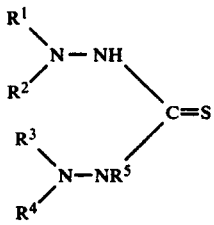

IV in which the substituents $R^1$ to $R^8$ have the meanings specified above.

The following are examples for suitable compounds:

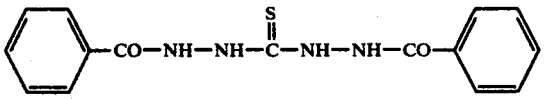

V

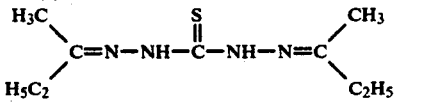

VI

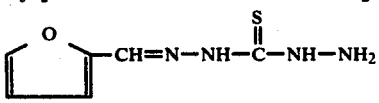

VII

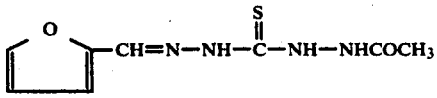

VIII

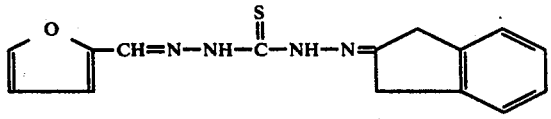

IX

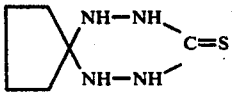

X

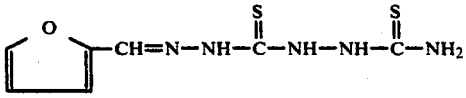

XI

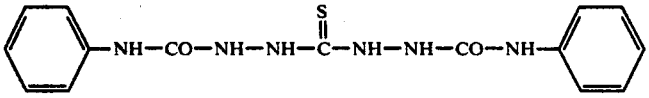

XII

-continued

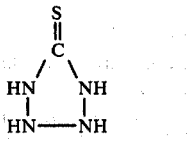

XIII

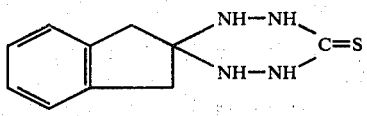

XIV

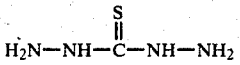

XV

Compound of preparation Example 2, as hereinafter described.

XVI

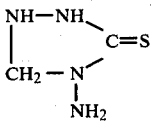

XVII

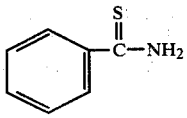

XVIII

The compounds of Formulae V–XVIII as well as the compounds of Formulae I–IV may, of course, carry alkyl or alkylene groups.

Preferably the compounds are well soluble in water. In one preferred embodiment the compounds are sugar derivatives, e.g. of a hexose or of a pentose, especially compounds derived from these sugars and thiocarbohydrazide, e.g. compound XVI.

The monohydrazones of thiocarbohydrazide may contain a cyclic structure in addition to the open chain structure (see R. W. LAMON, J.Org.Chem. 34 (1969) 756). Under certain conditions, therefore, some compounds, for example the compound of Formula VII, may exist partly or completely in the form of the cyclic structure.

The thiosemicarbazones of Formula III may be prepared in known manner by reacting the corresponding aldehydes or ketones with thiosemicarbazides, for example as described in Houben-Weyl Vol. IX, page 913.

The preparation of the compound represented by Formula VII is described below as an example of the preparation of compounds according to Formula IV:

Preparation Example 1, Compound VII (furfurylidene thiosemicarbohydrazide).

24 g of furfural and 26.5 g of thiocarbohydrazide in 150 ml of methanol are vigorously stirred. Stirring is continued for 30 minutes after the exothermic reaction has died down. The precipitate is suction filtered and recrystallised from methanol. 30.1 g of furfurylidene thiocarbohydrazide, melting at 186° to 187° C. are obtained.

Preparation Example 2, Compound XVI:

20 g of glucose are dissolved in 40 ml of water to which 0.5 mol of glacial acetic acid has previously been added. After the addition of 5 g of thiocarbohydrazide, the reaction mixture is heated to 50° C. with stirring. It dissolves after a short time. After a further 30 minutes' stirring at 50° C. and 2 hours at room temperature, 40 ml of n-propanol are added. After a further 2 hours, the resulting precipitate is suction filtered, washed with 40 ml of n-propanol and finally mixed with 90 ml of ethyl acetate, suction filtered and dried in air. 11.8 g of a product having the overall composition $C_{13}H_{28}N_4O_{11}S$ are obtained; the product sinters at 145° C. and is decomposed at 157° C.; according to the UV-spectrum the product has an absorption maximum $\lambda_{max}=238$ nm, $\epsilon=12.6\times10^3$.

Isolation of the compounds according to the invention may be dispensed with in suitable cases, especially if the components react together sufficiently rapidly and do not give rise to undesirable by-products. This method may be used to advantage if isolation of the reaction product is accompanied by a considerable loss in yield. For example, instead of compound XVI, the appropriate reaction mixture may be used for the purpose of the invention.

The process according to the invention may be applied to the treatment of a light-sensitive photographic material which contains couplers. These may be conventional colour couplers which are generally incorporated directly in the silver halide layers. The red sensitive layer, for example, contains a non-diffusible colour coupler for producing the cyan partial image, generally a coupler based in phenol or α-naphthol. The green sensitive layer contains at least one non-diffusible colour coupler for producing the magenta partial colour image, the colour couplers used in this layer generally being based on 5-pyrazolone or indazolone. The blue sensitive layer unit contains at least one non-diffusible colour coupler for producing the yellow partial colour image, generally a colour coupler having an open chain keto methylene group. Large numbers of colour couplers of these kinds are known and have been described in numerous Patent Specifications and other publications, for example in the publication "Farbkuppler" by W. Pelz in "Mitteilungen aus den Forschungslaboratorien der Agfa, Leverkusen/München, Volume III (1961) and the publication by K. Venkataraman in "The Chemistry of Synthetic Dyes", Vol. 4, 341–387, Academic Press (1971).

Two-equivalent couplers may be used as non-diffusible colour couplers. These two-equivalent couplers contain a releasable substituent in the coupling position so that they require only two equivalents of silver halide to form the dye, in contrast to the usual four-equivalent couplers. Suitable two-equivalent couplers include, for example, the known DIR couplers in which the removable group is released as a diffusible development inhibitor after the reaction with colour developer oxidation products. So-called white couplers may also be used to improve the properties of the photographic material.

The non-diffusible colour couplers and colour producing compounds are added to the light-sensitive silver halide emulsions or other casting solutions by the usual known methods. If they are water-soluble or alkali-soluble compounds, they may be added to the emulsions in the form of aqueous solutions, to which water-miscible organic solvents such as ethanol, acetone or dimethylformamide may be added. If the non-diffusible colour couplers and colour producing compounds are insoluble in water or alkalies, they may be emulsified in known manner, for example by mixing a solution of these compounds in a low boiling organic solvent directly with the silver halide emulsion or by first mixing it with an aqueous gelatine solution and then removing the organic solvent in the usual manner. The resulting emulsion of the given compound in gelatine is then mixed with the silver halide emulsion.

So-called coupler solvents or oil formers may also be used to assist emulsification of such hydrophobic compounds. These oil formers are generally higher boiling organic compounds which enclose, in the form of oily droplets, the non-diffusible colour couplers and development inhibitor releasing compounds which are required to be emulsified in the silver halide emulsions. Information on this subject may be found, for example, in U.S. Pat. Nos. 2,322,027; 2,533,514; 3,689,271; 3,764,336 and 3,765,897.

The usual silver halide emulsions are suitable for the present invention. The silver halide contained in them may be silver chloride, silver bromide, silver iodide or mixtures thereof.

The usual colour developer substances may be used, for example the following:

N,N-Dimethyl-p-phenylenediamine;
4-amino-3-methyl-N-ethyl-N-methoxyethylaniline;
monomethyl-p-phenylenediamine;
2-amino-5-diethylaminotoluene;
N-butyl-N-ω-sulphobutyl-p-phenylenediamine;
2-amino-5-(N-ethyl-N-β-methanesulphonamidoethyl-amino)-toluene;
N-ethyl-N-β-hydroxyethyl-p-phenylenediamine;
N,N-bis-(β-hydroxyethyl)-p-phenylenediamine and
2-amino-5-(N-ethyl-N-β-hydroxyethylamino)-toluene.

The binder used for the photographic layers is preferably gelatine but this may be partly or completely replaced by other binders. Suitable natural binders include, for example, alginic acid and its derivatives such as its salts, esters or amides, cellulose derivatives such as carboxymethylcellulose, alkylcelluloses such as hydroxyethylcellulose, starch or its derivatives such as its ethers or esters, or carrageenates.

Suitable synthetic binders include polyvinyl alcohol, partially saponified polyvinyl acetate and polyvinyl pyrrolidone.

The emulsions may also be chemically sensitized, e.g. by the addition of sulphur compounds such as allyl isothiocyanate, allylthiourea and sodium thiosulphate at the chemical ripening stage. Reducing agents may also be used as chemical sensitizers, e.g. the tin compounds described in Belgian Patent Specifications No. 493,464 and 568,687; polyamines such as diethylene triamine and aminomethanesulphinic acid derivatives, e.g. according to Belgian Patent Specification No. 547,323, may also be used.

Noble metals such as gold, platinum, palladium, iridium, ruthenium or rhodium and compounds of these metals may also be used as chemical sensitizers. This method of chemical sensitization has been described in the article by R. Koslowsky Z.Wiss.Phot. 46, pages 65 to 72 (1951).

The emulsions may also be sensitized with polyalkylene oxide derivatives, e.g. with a polyethylene oxide having a molecular weight of between 1000 and 20,000 or with condensation products of alkylene oxides and aliphatic carboxylic acids, aliphatic amines, aliphatic diamines and amides. The condensation products have a molecular weight of at least 700, preferably more than 1000. These sensitizers may, of course, also be combined to produce special effects, as described in Belgian Patent Specification No. 537,278 and British Patent Specification No. 727,982.

The emulsions may also be spectrally sensitized, e.g. with the usual monomethine or polymethine dyes such as acid or basic cyanines, hemicyanines, streptocyanines, merocyanines, oxonoles, hemioxonoles, styryl dyes or others, including also trinuclear or higher nuclear methine dyes, for example rhodacyanines or neocyanines. Sensitizers of this kind have been described, for example by F. M. Hamer in "The Cyanine Dyes and Related Compounds" (1964), Interscience Publishers John Wiley and Sons.

The emulsions may contain the usual stabilizers, e.g. homopolar or salt compounds of mercury containing aromatic or heterocyclic rings such as mercaptotriazoles, simple mercury salts, sulphonium mercury double salts and other mercury compounds. Azaindenes are also suitable stabilizers, particularly tetra- and penta-azaindenes, especially those which are substituted with hydroxyl or amino groups. Compounds of this kind have been described in the article by Birr. Z.Wiss. Phot. 47, pages 2–58 (1952). Other suitable stabilizers include heterocyclic mercapto compounds, e.g. phenylmercaptotetrazole, quaternary benzothiazole derivatives and benzotriazole.

The emulsions may also be hardened in the usual manner, for example with formaldehyde or halogenated aldehydes which contain a carboxyl group, such as mucobromic acid, diketones, methanesulphonic acid esters and dialdehydes.

The photographic layers may also be hardened with epoxide hardeners, heterocyclic ethyleneimine hardeners or acryloyl hardeners. Examples of such hardeners have been described, for example, in German Offenlegungsschrift No. 2,263,602 and British Patent Specification No. 1,266,655. The layers may also be hardened by the process according to German Offenlegungsschrift No. 2,218,009 to produce colour photographic materials which are suitable for high temperature processing.

The photographic layers or colour photographic multilayered materials may also be hardened with diazine, triazine or 1,2-dihydroquinoline hardeners, as described in British Pat. Nos. 1,193,290; 1,251,091; 1,306,544 and 1,266,655; French Patent No. 7,102,716; or German Offenlegungsschrift 23 32 317. The following are examples of such hardeners: Diazine derivatives containing alkylsulphonyl or arylsulphonyl groups, derivatives of hydrogenated diazines or triazines, e.g. 1,3,5-hexahydrotriazine, fluoro-substituted diazine derivatives e.g. fluoropyrimidines, esters of 2-substituted 1,2-dihydroquinoline- or 1,2-dihydroisoquinoline-N-carboxylic acids. Vinyl sulphonic acid hardeners, carbodiimide and carbamoyl hardeners may also be used, e.g. those described in German Offenlegungsschriften Nos. 2,263,602; 2,225,230 and 1,808,685, French Patent Specification No. 1,491,807, German Patent Specification No. 872,153 and DDR Patent Specification No. 7218. Other suitable hardeners have been described, for example, in British Patent Specification No. 1,268,550.

The usual substrates are used, for example foils of cellulose nitrate, cellulose acetate such as cellulose triacetate, polystyrene, polyesters such as polyethylene terephthalate, polyolefines such as polyethylene or polypropylene, baryta paper substrates and polyolefine laminated paper substrates, e.g. polyethylene laminated paper substrates, and glass.

According to the invention, a conventional photographic reversal material containing at least one silver halide emulsion layer, film or paper, is exposed imagewise and subjected to a black-and-white development and optionally, also to a short stop bath and washing with water. The photographic material is then treated with a solution of the fogging agent used according to the invention. After this treatment, the photographic material is introduced into an alkaline medium, optionally after being first washed, and developed with a second developer to form a positive reversal image.

The concentration of fogging agent to be used according to the invention in the bath containing the fogging agent may vary within wide limits, for example from 0.5 to 1000 mg per liter, and is preferably within the range of from 5 to 200 mg per liter. In some cases, even minimum concentrations of less than 5 mg per liter ensure optimum fogging.

In individual cases it may be advantageous to use the compounds according to the invention together with known fogging agents such as those described in German Reichspatent No. 745,440 and U.S. Pat. No. 2,150,704.

The fogging bath may contain the usual reagents to adjust it to an alkaline pH, such as hydroxides of the alkali metals or alkaline earth metals or of ammonium, or carbonates, phosphates or borates of the alkali metals or of ammonium or substituted ammonium. The fogging baths may also contain complex formers.

The compounds used according to the invention may be used in acid or neutral baths preceding the fogging bath. These baths may contain the usual additives, e.g. buffers and complex formers. These baths may contain e.g. acetic-, propionic or ascorbic acid and sulphites.

The advantages of the process according to the invention compared with previously employed fogging processes lie mainly in the high stability of the fogging agents used according to the invention and in their uniform fogging action on the individual emulsion layers of a conventional photographic reversal material which contains more than one silver halide emulsion layer. A particular advantage of the substances used according to the invention is that they ensure optimum fogging at concentrations at which known fogging agents produce quite inadequate fogging.

The invention will now be explained with the aid of the following Examples.

EXAMPLE 1

A commercial colour photographic multilayered reversal material containing a red-sensitive, a green-sensitive and a blue-sensitive silver halide emulsion layer and containing colour couplers for the various partial images in the appropriate light-sensitive layers is exposed imagewise in the usual manner. The exposed colour photographic material is then subjected to a first development in a developer having the following composition per liter:

| Development bath 1 | |
|---|---|
| p-Methylaminophenol | 3.0 g |
| Hydroquinone | 6.0 g |
| Sodium carbonate | 40.0 g |
| Sodium sulphite | 50.0 g |
| Potassium bromide | 2.0 g |
| Potassium iodide | 0.01 g |
| Potassium thiocycanate | 2.5 g |
| pH 10.2. | |

After a short stop bath, the photographic material is subjected to a completely diffuse second exposure and washed. A second development for colour reversal is then carried out in a bath having the following composition (quantities given per liter):

| Development bath 2 | |
|---|---|
| Sodium sulphite | 5.0 g |
| Hydroxylamine sulphate | 1.2 g |
| N,N-diethyl-p-phenylenediaminosulphate | 5.0 g |
| Potassium carbonate | 75.0 g |
| Potassium bromide | 2.0 g |
| Ethylene diaminotetracetic acid | 2.0 g |
| Adjustment to pH 12.1. | |

After this treatment, the photographic material is treated in a short stop bath and washed, then bleached and fixed in known manner and finally washed again.

EXAMPLE 2

The colour photographic reversal material according to Example 1 is exposed imagewise and processed in the same way as described in Example 1 except that the second exposure is replaced by a 2-minutes' treatment in an aqueous preliminary bath A having the following composition (quantities per liter):

| Preliminary bath A | |
|---|---|
| Nitrilotriacetic acid | 2.0 g |
| Thioacetamide | 0.4 g |
| Sodium acetate | 2.0 g |
| Adjustment of pH to 5.6. | |

The maximum colour densities obtained when the photographic material is fogged with thioacetamide are 80% of the values obtained when the second exposure is employed in the process described in Example 1.

EXAMPLE 3

Colour photographic reversal material according to Example 1 is processed in the same way as indicated in Example 2 except that the thioacetamide in the preliminary bath is replaced by 10 ml of a 0.1% methanolic solution of Compound VII. The maximum colour densities obtained are 95% of the values obtained when processing is carried out with a second exposure as described in Example 1, in spite of the fact that only minimum quantities of fogging agent are used.

EXAMPLE 4

The colour photographic reversal material according to Example 1 is exposed imagewise and processed in the same way as described in Example 2 except that the thioacetamide in the preliminary bath is replaced by the addition of 5 ml, in each case, of a 0.1% methanolic solution of compounds according to Formulae VII and XIV. A comparison of the maximum colour densities obtained shows that in spite of the minimum concentration of fogging agents, the maximum densities obtained amount to as much as 95% of those obtained in Example 1.

EXAMPLE 5

The colour photographic reversal material according to Example 1 is processed in the same way as described in Example 3 but with omission of one or both washings and/or of the short stop bath before the second development. In each of these methods, 95% of the maximum colour densities produced with the second exposure according to Example 1 are obtained with the same sensitivity.

EXAMPLE 6

The colour photographic reversal material according to Example 1 is processed in the same way as described in Example 2 except that as preliminary bath an aqueous bath is used, which contains per liter 120 mg of Compound XVI. The maximum densities obtained amount to as much as of these of Example 1 and are scarcely subject to relatively great changes in concentration of Compound XVI.

We claim:

1. A process of producing a positive photographic image by imagewise exposure of photographic reversal material containing at least one silver halide emulsion, a first black and white development of the exposed material and subsequent treatment of the first developed material including a second development of the photographic material to form a positive reversal photographic image in the material wherein the improvement comprises uniform fog treatment of the first developed photographic material with an aqueous solution of a compound corresponding to the following formula

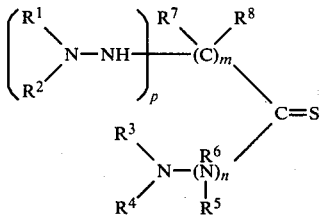

wherein $R^1$, $R^3$=hydrogen, a saturated or olefinically unsaturated aliphatic group, aryl, a heterocyclic group or acyl;

$R^2$, $R^4$=hydrogen, a saturated or olefinically unsaturated aliphatic group, aryl or a heterocyclic group;

$R^5$=hydrogen;

$R^6$, $R^7$, $R^8$=hydrogen, a saturated or olefinically unsaturated aliphatic group, or aryl;

n=0 or 1;

m, p=0 or 1 but m and p must never have the same value;

and/or $R^1$ and $R^2$ together and/or $R^4$ and $R^3$ together may represent an alkylidene group and/or $R^6$ and $R^7$ and $R^8$ together with the carbon atom, to which they are joined, represent a carbocyclic ring and/or $R^2$ together with $R^4$ or $R^5$ represent the group required for completing a 5-membered or 6-membered heterocyclic ring to form developable specks by chemical fogging in the unexposed and undeveloped silver halide of said material, and then second developing the treated material with a second developer to form said positive reversal photographic images, said compound being in an amount of about 0.5–1000 mg per liter of said solution, whereby the processing produces in the treated emulsion layer a developed image having a density essential corresponding to that produced by a reversal process development in which the first developed material is uniformly exposed to light.

2. Process according to claim 1, characterized in that $R^1$ and $R^2$ form a methylidene group in which the two substituents which are joined to the carbon atom of the methylidene group through a single bond complete a carbocyclic or heterocyclic ring together with the carbon atom of the methylidene group.

3. Process according to claim 1, characterized in that at least one compound according to the following formulae is used as fogging agent

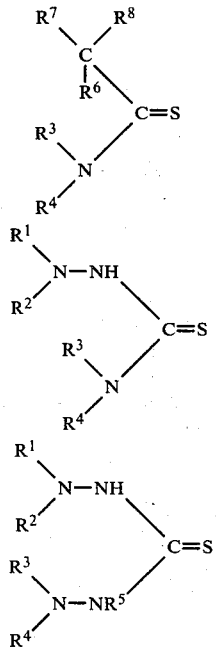

wherein $R^1$, $R^3$=hydrogen, a saturated or olefinically unsaturated aliphatic group, aryl, a heterocyclic group or acyl;

$R^2$, $R^4$=hydrogen, a saturated or olefinically unsaturated aliphatic group, aryl or a heterocyclic group;

$R^5$=hydrogen;

$R^6$, $R^7$, $R^8$=hydrogen, a saturated or olefinically unsaturated aliphatic group, aryl;

and/or $R^1$ and $R^2$ together and/or $R^4$ and $R^3$ together may represent an alkylidene group and/or $R^6$ and $R^7$ and $R^8$ together with the carbon atom, to which they are joined, represent a carbocyclic ring and/or $R^2$ together with $R^4$ or $R^5$ represent the group required for completing a 5-membered or 6-membered heterocyclic ring.

4. Process according to claim 1, characterized in that $m=0$ and $R^3$, $R^4$ and $R^5$ are hydrogen.

* * * * *

UNITED STATES PATENT AND TRADEMARK OFFICE

CERTIFICATE OF CORRECTION

PATENT NO. : 4,184,875

DATED : January 22, 1980

INVENTOR(S) : Odenwalder et al

It is certified that error appears in the above—identified patent and that said Letters Patent is hereby corrected as shown below:

Column 2, at lines 20-29, the following formula should be deleted:

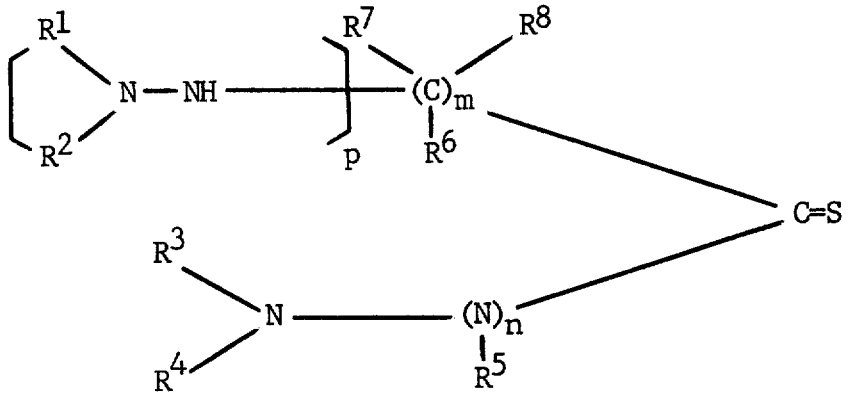

UNITED STATES PATENT AND TRADEMARK OFFICE

CERTIFICATE OF CORRECTION

PATENT NO. : 4,184,875

DATED : January 22, 1980

INVENTOR(S) : Odenwalder et al.

It is certified that error appears in the above—identified patent and that said Letters Patent is hereby corrected as shown below:

Column 11, in the formula of Claim 1, lines 46-55, the formula should read:

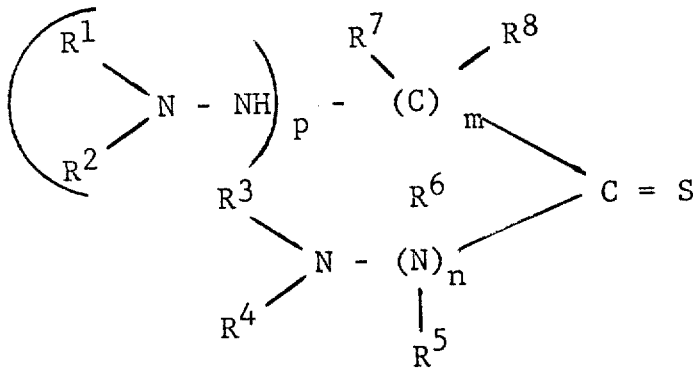

Signed and Sealed this

Twenty-eighth Day of April 1981

[SEAL]

Attest:

RENE D. TEGTMEYER

Attesting Officer

Acting Commissioner of Patents and Trademarks

UNITED STATES PATENT AND TRADEMARK OFFICE

CERTIFICATE OF CORRECTION

PATENT NO. : 4,184,875

DATED : January 22, 1980

INVENTOR(S) : Odenwalder et al

It is certified that error appears in the above—identified patent and that said Letters Patent is hereby corrected as shown below:

Column 11 in the formula, show the bond between the carbon atom (C) and the substituent $R^6$ so that the formula in claim 1 reads as follows:

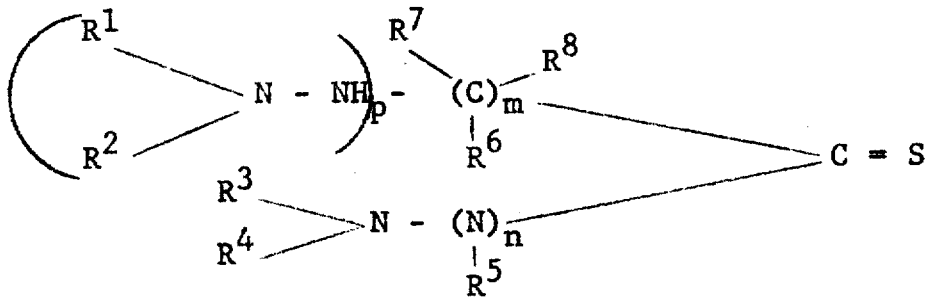

Signed and Sealed this

Seventh Day of September 1982

[SEAL]

Attest:

GERALD J. MOSSINGHOFF

Attesting Officer

Commissioner of Patents and Trademarks